US012029966B2

(12) United States Patent
Pellegrino

(10) Patent No.: US 12,029,966 B2
(45) Date of Patent: Jul. 9, 2024

(54) GYMNASTICS OR FUNCTIONAL FITNESS GRIP

(71) Applicant: VICTORY GRIPS LLC, Tybee Island, GA (US)

(72) Inventor: Victor Brian Pellegrino, Tybee Island, GA (US)

(73) Assignee: VICTORY GRIPS LLC, Tybee Island, GA (US)

( * ) Notice: Subject to any disclaimer, the term of this patent is extended or adjusted under 35 U.S.C. 154(b) by 0 days.

(21) Appl. No.: 17/744,394

(22) Filed: May 13, 2022

(65) Prior Publication Data

US 2023/0364490 A1 Nov. 16, 2023

(51) Int. Cl.
*A41D 13/08* (2006.01)
*A63B 71/14* (2006.01)

(52) U.S. Cl.
CPC ..... *A63B 71/141* (2013.01); *A41D 13/082* (2013.01); *A63B 2209/10* (2013.01)

(58) Field of Classification Search
CPC ..... A41D 13/082; A41D 13/081; A41D 19/0048; A63B 71/141
See application file for complete search history.

(56) References Cited

U.S. PATENT DOCUMENTS 1,369,810 A * 3/1921 Hinze ..... A41D 13/082 2/168
1,667,926 A * 5/1928 Dom Browsky .... A41D 13/082 2/20
2,077,202 A * 4/1937 Barrie ..... A01J 1/00 473/59
2,769,179 A * 11/1956 Love ..... F41B 5/1473 D29/113
4,617,684 A * 10/1986 Green ..... A41D 13/082 2/19
5,298,001 A * 3/1994 Goodson ..... A63B 21/4019 2/161.1
5,350,343 A * 9/1994 DaSilva ..... A63B 21/4021 482/106
5,353,440 A * 10/1994 Meldeau ..... A41D 19/01547 2/161.1

(Continued)

FOREIGN PATENT DOCUMENTS

| | | |
|---|---|---|
| EP | 2591687 | 5/2013 |
| EP | 2633771 | 9/2013 |
| WO | WO 2022/261000 | 12/2022 |

OTHER PUBLICATIONS

Invitation to Pay Additional Fees and, Where Applicable, Protest Fee in International Appln. No. PCT/US2023/022038, dated Sep. 8, 2023, 14 pages.

(Continued)

*Primary Examiner* — Jillian K Pierorazio
(74) *Attorney, Agent, or Firm* — Fish & Richardson P.C.

(57) ABSTRACT

Disclosed is a grip that includes a protective material having a wrist end, a finger end, and sides that extend from the wrist end to the finger end. A wrist strap is attached to a leg of the wrist end of the protective material. The wrist end the protective material has a concave shape that (i) is between the sides of the protective material and (ii) defines at least two legs on opposite sides of an apex of the concave shape.

20 Claims, 6 Drawing Sheets

(56) References Cited

U.S. PATENT DOCUMENTS

| | | | | |
|---|---|---|---|---|
| 5,898,944 | A * | 5/1999 | Vrany | A41D 19/01547 2/163 |
| 6,119,267 | A * | 9/2000 | Pozzi | A41D 13/088 2/161.1 |
| 6,279,159 | B1 * | 8/2001 | Ahlbaumer | A41D 13/082 2/16 |
| D710,955 | S * | 8/2014 | Boruch | D21/662 |
| 9,643,073 | B1 | 5/2017 | Pellegrino | |
| D804,589 | S * | 12/2017 | Boruch | D29/113 |
| D873,936 | S | 1/2020 | Pellegrino | |
| D874,585 | S | 2/2020 | Pellegrino et al. | |
| 10,576,356 | B1 * | 3/2020 | Pellegrino | A63B 71/14 |
| 10,702,761 | B2 | 7/2020 | Pellegrino | |
| 10,835,804 | B1 * | 11/2020 | Pellegrino | A63B 71/14 |
| D932,710 | S * | 10/2021 | Jenni | D29/113 |
| D979,671 | S | 2/2023 | Pellegrino | |
| 2005/0268374 | A1 | 12/2005 | Mattesky | |
| 2009/0126074 | A1 | 5/2009 | Mattesky | |
| 2012/0210483 | A1 | 8/2012 | Fricke et al. | |
| 2013/0227755 | A1 * | 9/2013 | Bisaillon | A63B 71/141 2/161.1 |
| 2015/0143607 | A1 | 5/2015 | Ramirez | |
| 2017/0087438 | A1 * | 3/2017 | Bisaillon | A41D 19/01523 |
| 2017/0026904 | A1 | 10/2017 | Blazhko et al. | |
| 2017/0296904 | A1 | 10/2017 | Blazhko et al. | |
| 2017/0348584 | A1 * | 12/2017 | Rhodes | A63B 71/14 |
| 2018/0110269 | A1 * | 4/2018 | Koven | G16H 20/30 |
| 2018/0140929 | A1 * | 5/2018 | Pellegrino | A63B 71/141 |
| 2019/0001180 | A1 | 1/2019 | Pellegrino et al. | |
| 2020/0046044 | A1 * | 2/2020 | Faim | A41D 13/082 |
| 2020/0121975 | A1 * | 4/2020 | Starominsky | A63B 71/00 |
| 2020/0275716 | A1 | 9/2020 | Salvator et al. | |
| 2021/0023435 | A1 * | 1/2021 | Pellegrino | A63B 71/141 |
| 2021/0170258 | A1 * | 6/2021 | Pellegrino | A63B 71/14 |

OTHER PUBLICATIONS

International Search Report and Written Opinion in International Appln. No. PCT/US2023/022038, dated Nov. 30, 2023, 21 pages.

* cited by examiner

GYMNASTICS OR FUNCTIONAL FITNESS GRIP

BACKGROUND

This specification relates to hand protection, and a grip that is useful for protecting a hand during gymnastics or functional fitness exercise.

There are many different exercise movements that can result in injury to hands. Some of these exercises are performed on horizontal bars and gymnastics rings. During these exercises skin that is in contact with the bars or rings experience friction that can lead to injury. Grips can help protect hands from injuries when performing various exercise movements.

SUMMARY

In general, one innovative aspect of the subject matter described in this specification can be embodied in a grip with a protective material having a wrist end, a finger end, and sides that extend from the wrist end to the finger end. A wrist strap is attached to a leg of the wrist end of the protective material. The wrist end the protective material has a concave shape that (i) is between the sides of the protective material and (ii) defines at least two legs on opposite sides of an apex of the concave shape.

These and other embodiments can each optionally include one or more of the following features.

The concave shape can be defined by an arched void, a semicircle void, or an angled void at the wrist end of the protective material.

The wrist strap can be secured to the protective material at an anchor location in a first leg among the at least two legs.

A wrist strap hole can be located in a second leg that is on an opposite side of the apex of the concave shape than the anchor location.

The protective material can have different widths at different locations along an axis that extends between the wrist end and the finger end.

The wrist strap can include an elastic section and a non-elastic section. The elastic section can be attached to the wrist end of the protective material at the anchor location. The non-elastic section can be secured to a side of the elastic section that is more proximate to the anchor location than an opposite side of the elastic section.

The protective material can have zero, one, two, three, four, or more finger holes defined through a plane formed by the protective material laid flat.

An end of the elastic section of the wrist strap that can be farthest away from the wrist strap junction includes a hook fastener material or a loop fastener material.

In general, one innovative aspect of the subject matter described in this specification can be embodied in a method that includes forming a protective material having a wrist end, a finger end, and sides that extend from the wrist end to the finger end; and attaching a wrist strap to the wrist end of the protective material, where the wrist end the protective material has a concave shape that (i) is between the sides of the protective material and (ii) defines at least two legs on opposite sides of an apex of the concave shape.

These and other embodiments can each optionally include one or more of the following features.

The method of claim 10, wherein forming the protective material comprises forming the concave shape that defines an arched void, a semicircle void, or an angled void at the wrist end of the protective material.

Attaching the wrist strap to the protective material can include securing the wrist strap to the protective material at an anchor location in a first leg among the at least two legs.

Forming the protective portion can include forming a wrist strap hole in a second leg that is on an opposite side of the apex of the concave shape than the anchor location.

Forming the protective material can include forming the protective material to have different widths at different locations along an axis that extends between the wrist end and the finger end.

The method can include assembling the wrist strap. The wrist strap can include an elastic section and a non-elastic section that are attached at a wrist strap junction. Attaching a wrist strap to the wrist end of the protective material can include attaching the elastic section to the wrist end of the protective material at the anchor location.

Assembling the wrist strap can include securing the non-elastic section to a side of the elastic section that is more proximate to the anchor location than an opposite side of the elastic section.

Forming the protective material can include forming zero, one, two, three, four, or more finger holes through a plane formed by the protective material laid flat.

An end of the elastic section of the wrist strap that is farthest away from the wrist strap junction can include a hook fastener material or a loop fastener material.

Particular embodiments of the subject matter described in this specification can be implemented so as to realize one or more of the following advantages. The concave shape of the wrist end of the protective material distributes the forces on the wrist when doing pulling exercises, such as pull ups, leading a more even distribution of the forces around the writs and a more comfortable fit. The elastic portion of the wrist strap is wider than the non-elastic portion of the wrist strap to provide enhanced wrist support and a more comfortable fit.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
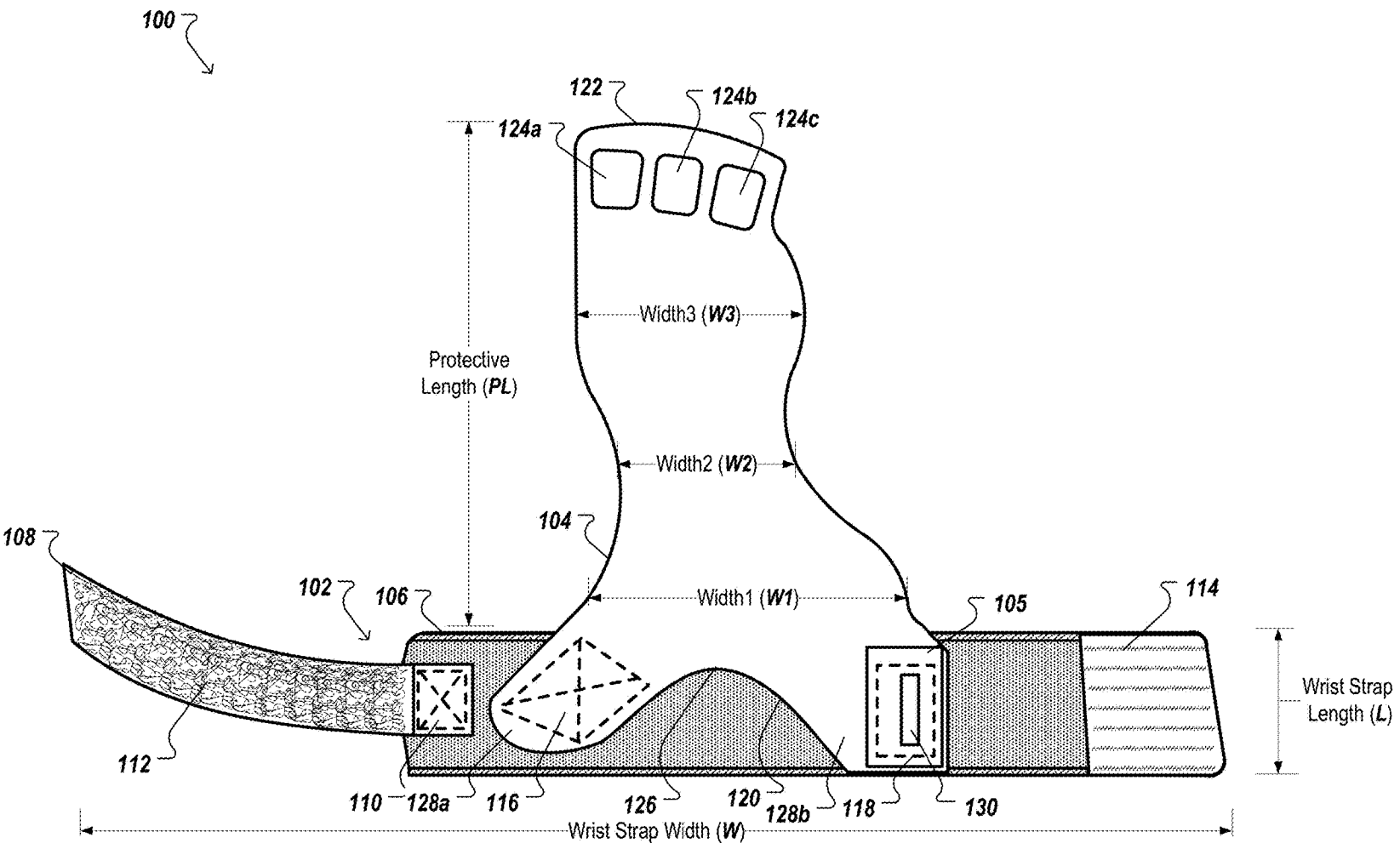
FIG. 1A is an illustration of a grip laid flat.

A grip useful for protecting hands during exercise is disclosed. The grips disclosed herein are particularly useful for protecting the palm and wrist while an athlete is performing gymnastics movements, such as pull ups, ring muscle ups, or bar muscle ups. The protective material of the grips described herein have a unique shape that has been designed to distribute the forces placed on the wrist during pulling movements, such as pull ups, which reduces the pressure that conventional grips place on certain portions of the wrist. For example, the concave shape of the wrist end of the protective material of the grips described herein distributes the force around the wrist, rather than concentrating the force on a small area of the wrist, thereby providing more comfort than traditional grips and enhancing the durability of the grips.

The wrist strap of the present grips also differs from conventional grips to provide a more comfortable fit, and to provide additional wrist support as compared to conventional grips. For example, the wrist straps of the present grips have an elastic section and an inelastic/non-elastic section. The elastic section has a larger length (as measured as described herein) than the non-elastic section, and is configured to stretch around the wrist, thereby providing wrist support while performing Olympic Lifts or other exercise movements that flex the wrists. Meanwhile, the non-elastic section is has a smaller length than the elastic section, and is configured to secure the wrist strap around the wrist and provide rigidity to reduce unwanted movement of the wrist strap or grip—e.g., to prevent the wrist strap from moving from the wrist of a wearer to the palm of the wearer when the non-elastic section is tightened around the wrist and secured, e.g., using a hook and loop fastener or another fastener.

Meanwhile, the shape of the grip still provides adequate coverage of portions of the palm that experience high levels of friction during these gymnastics movements, while also exposing other portions of the palm to enable better hand articulation than traditional gymnastics grips. The enhanced hand articulation provided by the present grips enables the athlete to transition between gymnastics movements and other exercises, such as Olympic lifting (e.g., clean and jerk or snatch) or powerlifting (e.g., deadlifts and bench press) while wearing the grips.

In this specification, relative widths of the protective material can be measured at different locations along a reference axis that passes through the finger end of the protective material and an edge of the wrist strap that is closest to the finger end of the protective material. The reference axis can intersect the edge of the protective material at the finger end of the protective material and be perpendicular to the edge of the wrist strap that is closest to the finger end of the protective material. At each location along the reference axis, the width of the protective material can be measured between the sides of the protective material at that location on the reference axis. Meanwhile, the length of the wrist strap can be measured in the direction of the reference axis, while the width of the wrist strap, as well as the widths of the component sections of the wrist strap can be measured in a direction of an orthogonal axis that is orthogonal to the reference axis (e.g., in the same direction as the width of the protective material). Sides (or side edges) of the protective material extend from and between the finger end ant the wrist end. As used herein, the terms non-elastic and inelastic, which are used interchangeably, do not refer to absolute rigidity or an absolute lack of elasticity. Rather, these terms are used to indicate a relative difference of elasticity between the elastic material and the inelastic material, thereby indicating that the elastic material has higher elasticity than the inelastic material.

Figure 1B:
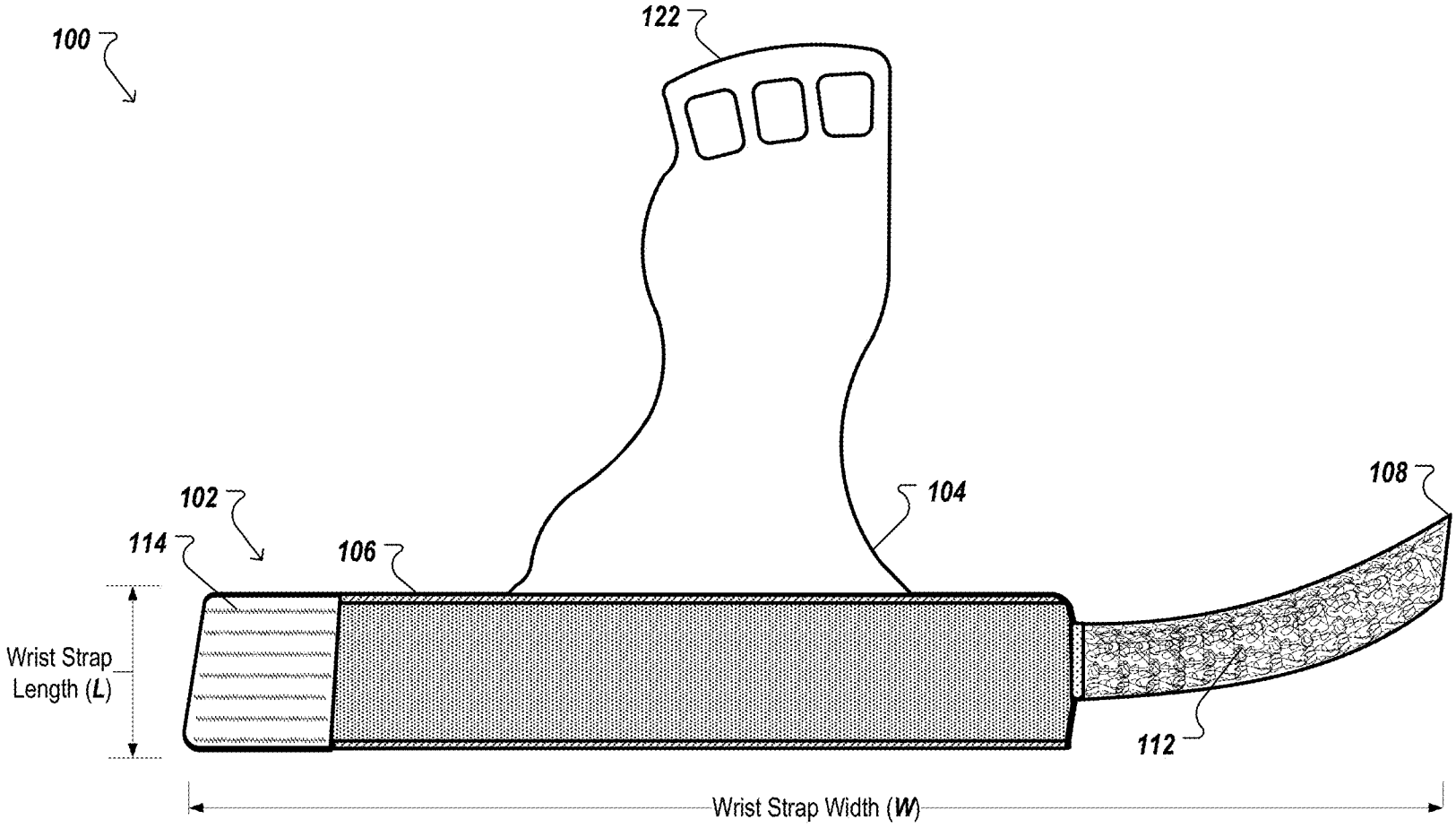
FIG. 1B is another illustration of the grip laid flat.

FIG. 1A is an example illustration of a grip 100 that is laid flat. The grip 100 includes a wrist strap 102 having a wrist strap width (W) and a wrist strap length (L). The grip also includes a protective material 104 that is attached to the wrist strap 102. The protective material 104 has a wrist end 120 and a finger end 122. The surface of the protective material 104 that is shown in FIG. 1A is the surface that faces and/or come into direct contact with an athlete's palm when the grip is worn, which is also referred to as a "palm-facing surface" of the grip 100. The grip 100 shown in FIGS. 1A and 1B is configured to be worn on an athlete's right hand.

In some implementations, the wrist strap 102 can be formed from multiple different materials. For example, the wrist strap 102 can be formed using an elastic material 106 and an inelastic material 108. The elastic material 106 and the inelastic material 108 can be sewn together (or otherwise attached/joined) at a wrist strap junction 110, which is an area at which the elastic material 106 is secured (or otherwise joined) to the inelastic material 108. In some implementations, the inelastic material 108 can be, or include, a hook (or loop) fastener material 112 that enables the inelastic material 108 to be secured to a corresponding loop (or hook) fastener material that is also part of the wrist strap 102. When referring to the wrist strap 102, a portion of the wrist strap 102 that is formed using the inelastic material 108 is referred to as the inelastic section (or non-elastic section), and the portion of the wrist strap 102 that is formed using the elastic material 106 is referred to as the elastic section. As illustrated, the non-elastic section is secured to a side of the elastic section that is more proximate to an anchor location 116 (discussed below) than the opposite side of the elastic section at which a fastener section 114 is located. In some implementations, the length of the elastic section is larger than the length of the non-elastic section. For example, in some implementations, the distance between a top edge (e.g., closest to a most distal edge of the finger end) and a bottom edge (e.g., farthest from the most distal edge of the finger end) of the non-elastic section will be smaller than a distance between the top edge and the bottom edge of the elastic section.

Portions of the wrist strap 102 can be formed separate from the protective material 104, and sewn, or otherwise attached (e.g., with adhesive) to the protective material 104. For example, the elastic section of the wrist strap 102 can be sewn to the protective material 104 at the anchor location 116. The anchor location 116 refers to an area at which the protective material 104 and the wrist strap 102 are joined together. As illustrated by FIG. 1A, the protective material 104 and the wrist strap 102 are joined together using stitching in an cross pattern within rectangle stitching, but any appropriate manner of joining the wrist strap 102 and the protective material 104 can be used. Also, FIG. 1A, shows that there is only one anchor location 116 that joins the wrist strap 102 and the protective material 104, which is a way to connect the elastic material 106 to the protective material 104 without overly limiting the elastic properties of, and/or comfort provided by, the elastic section of the wrist strap 102. However, it is possible to join the wrist strap 102 and the protective material 104 using multiple anchor locations 116.

As shown, a single anchor location 116 is located closer to one side of the elastic material 106 than the other side of the elastic material 106 (i.e., closer to the left side edge of the width than the right edge). In this example, the protective material 104 is attached to one side of the elastic section, and not connected to the opposite side of the elastic section.

To distribute forces exerted on the wrist by the grip when performing pulling movements (e.g., performing pull ups on a pull up bar), the edge of the wrist end 120 has a concave shape between the sides of the protective material 104. The sides of the protective material 104 are the edges of the protective material that extend from and between the wrist end 120 and the finger end 122. As shown, an apex 126 of the concave shape is at a shortest length of the protective material 104 (as measured from the mid-point of the edge of the finger end 122 and the edge of the wrist end 120 at the apex 126), and the length of the protective material 104 increases toward the sides of the protective materials 104 (assuming that the measurement location at the finger end remains fixed). The two longer sections of the protective material that are on opposite sides of the apex 126 of the concave shape can be referred to as legs of the protective material 104, and the wrist end 120 of the protective material 104 can have at least two legs 128*a*, 128*b*. As shown, the anchor location 116 is located in one leg 128*a* of the protective material 104.

The concave shape of the wrist end 120 is illustrated as defining, or being defined by, an arched void at the wrist end, such that the edge of the wrist end 120 forms a smooth curve, but the concave shape can be created/defined in other ways. For example, the concave shape can be created/defined using a semicircle void, an angled void, or another shape that creates a concave shape at the wrist end of the protective material 104.

In some implementations, a reinforcement element 105 is formed in an opposite side of the protective material 104 relative to the anchor location 116. As shown, the reinforcement element 105 is formed in the opposite leg 128*b* of the protective material than the location of the anchor location 116, which is in the leg 128*a*. The reinforcement element 105 can be formed in several ways, and is secured to the protective material 104, e.g., using stitching 118 or another securing mechanism. For example, the reinforcement element 105 can be a portion of the protective material 104 that is wrapped around the right side (in the current view) of the protective material 104, and is sewn to the protective material 104. In some implementations, the protective material 104 has a wrist strap hole 130 defined on the side of the protective material 104 around which the reinforcement element 105 is wrapped. For example, the reinforcement element 105 can have a hole defined therein, and that hole can be aligned with the wrist strap hole 130 that is defined in the leg 128*b* of the protective material 104, which is on the opposite side of the apex 126 of the concave shape than the wrist strap junction. Once the holes are aligned, the reinforcement element 105 of the wrist strap 102 can be secured (e.g., sewn) to the protective material 104. In some implementations, the reinforcement element 105 can be a separate piece of material (i.e., relative to the protective material 104) that is similarly secured to the protective material and may or may not wrap around the side of the protective material 104.

The protective material 104 can have zero, one, two, three, four, or more finger holes defined therein, and the finger holes can be defined at a location of the protective material 104 that is closer to the finger end 122 than the wrist end 120. The finger holes are defined through a plane defined by the protective material when the protective material is laid flat. FIG. 1A shows an implementation having 3 finger holes 124*a*, 124*b*, and 124*c* defined through the plane of the protective material that is laid flat.

In some implementations, the finger holes 124*a*, 124*b*, and 124*c* can be omitted from the protective material 104 to form a "fingerless" version of the grip 100 that is not worn over the fingers of the athlete. Omitting the finger holes enables the athlete to quickly transition from using the grip 100 for gymnastics movements to not using the grip 100, for example, when transitioning to perform non-gymnastics movements, without having to take the time to remove the wrist strap or otherwise take the grip off.

The width of the protective material 104 varies along a protective length (PL) of the protective material 104. In other words, the protective material has different widths at different locations along an axis that extends between (and passes through) the wrist end 120 and the finger end 122. For example, the protective material 104 has a first width (W1) at a first location that is between the anchor location 116 and a narrowest portion of the protective material 104. As illustrated, the first location of the first width (W1) is between a top edge of the elastic material 106 (e.g., an edge of the elastic material that is closer to the finger end 122 than an opposite edge of the elastic material). The protective material 104 has a second width (W2) that is further away from the top edge of the elastic material 106 than the first width (W1). As shown, the second width (W2) is smaller than the first width. The protective material has a third width (W3) that is further away from the top edge of the elastic material 106 than the second width (W2). As shown, the third width (W3) is larger than the second width (W2). In some implementations, the third width (W3), which is closer to the finger end 122 than either of the first width (W1) or the second width (W2), is smaller than the first width (W1), which is closer to the wrist end 120 than either of the second width (W2) or the third width (W3).

FIG. 1B is another illustration of the example grip 100 laid flat. The surface of the protective material 104 that is shown in FIG. 1B is the surface that faces away from an athlete's palm when the grip is worn. In FIG. 1B, the legs 128*a* and 128*b* of FIG. 1A are not visible because they are occluded by the elastic material 106 in this view. As illustrated in FIG. 1B, the fastener section 114 is at the opposite end of the elastic material 106 than the inelastic material 108. The fastener section 114 can have a hook (or loop) material on this side of the wrist strap 102, on the opposite side of the wrist strap shown in FIG. 1B, or both sides can have the hook (or loop) material. Of course, the hook (or loop) material can be limited to one side as appropriate (e.g., if the hook or loop is not needed on both sides to secure the grip to a wearer's wrist). In some situations, the fastener section 114 can be a portion of the elastic material to on which the hook or loop material is secured (e.g., sewn on). In FIG. 1B, the inelastic material 108 is shown having a hook (or loop) fastener material 112 on this side of the wrist strap as well, and the hook (or loop) fastener material can similarly be included on one or both sides of the inelastic material, as appropriate.

Figure 2A:
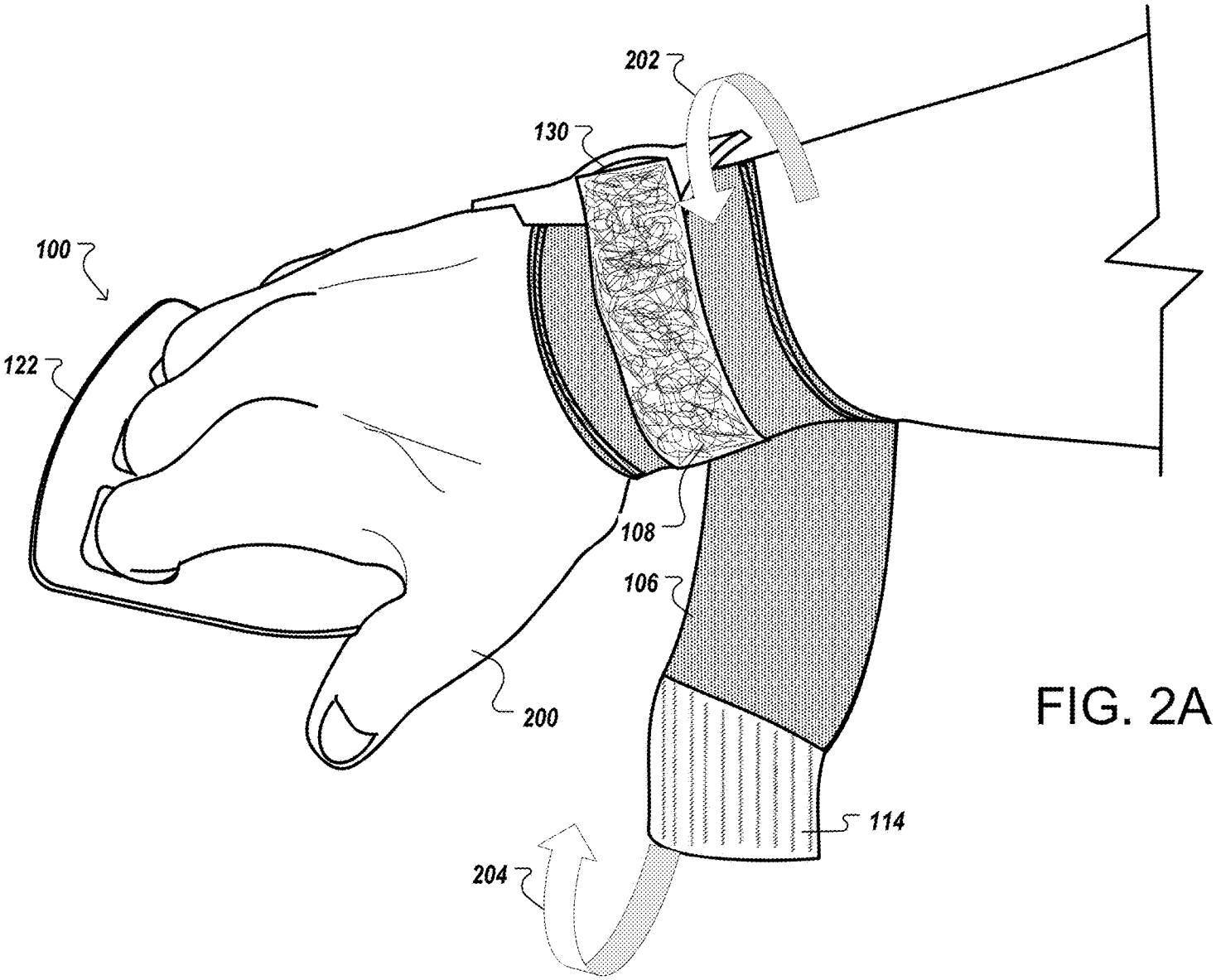
FIG. 2A is another illustration of the grip, as worn on a hand.
Figure 2B:
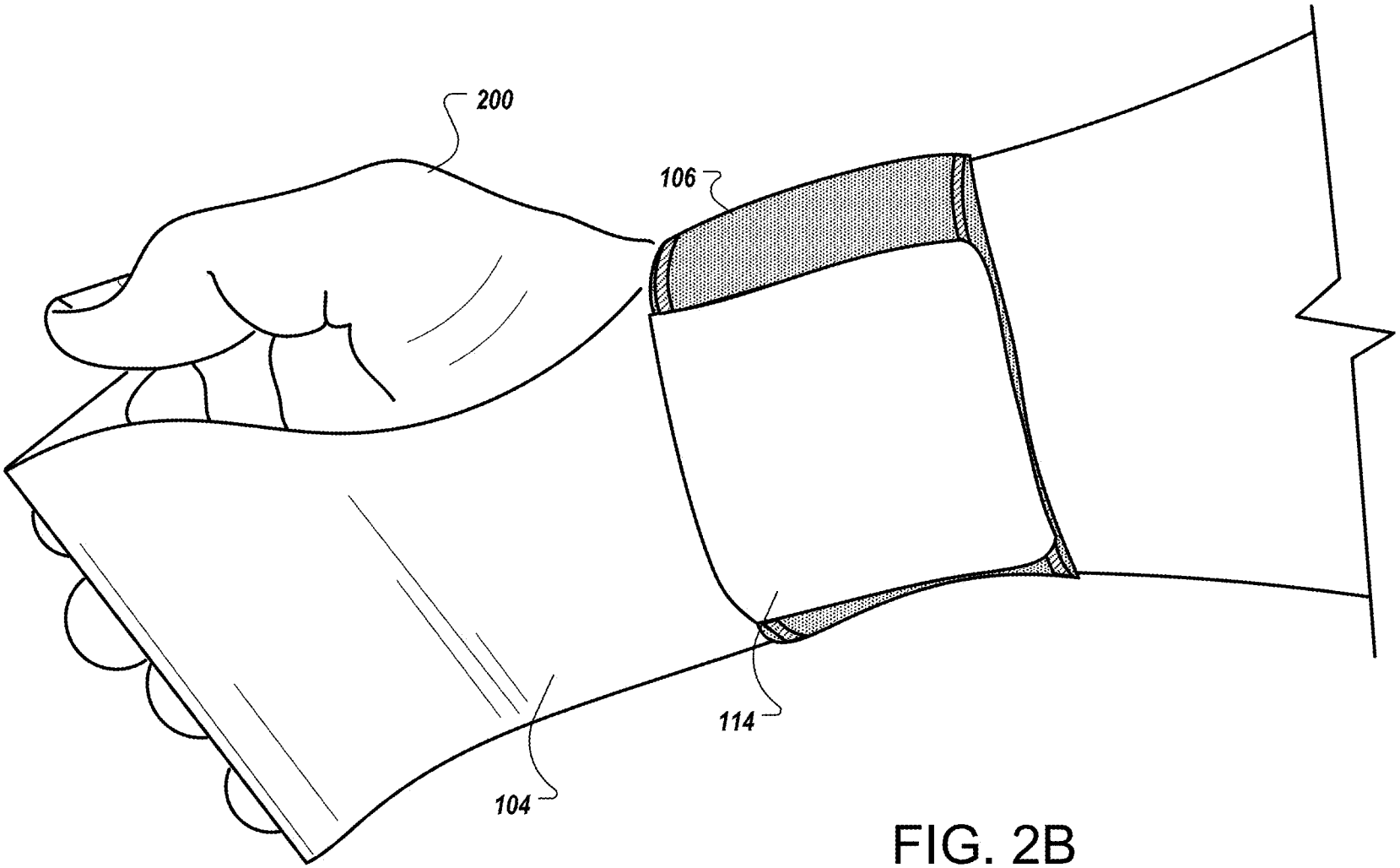
FIG. 2B is another illustration of the grip, as worn on a hand.

FIG. 2A is another illustration of the example grip 100, as worn on a hand 200. FIG. 2A highlights the way that the wrist strap 102 is wrapped around the wrist so that the inelastic material 108 can be fed through the wrist strap hole 130, and wrapped back in the opposite direction to secure the inelastic material 108 to the elastic material 106, as illustrated by the arrow 202. In other words, the inelastic material 108 is fed through the wrist strap hole 130 from underneath the current view. The inelastic material 108 is the pulled through the wrist strap hole 130, and then pulled back in the opposite direction to secure the inelastic material to the elastic material 106 (e.g., by way of the loop and/or hook material). Once the inelastic material 108 is secured, the remaining portion of the elastic material 106 can be wrapped around the wrist in the opposite direction (e.g., as illustrated by the arrow 204) and secured to itself using the fastener section 114 (e.g., by way of the hook and/or loop material), as shown in FIG. 2B. Note that in FIG. 2B, the fastener material is illustrated without fill, indicating that the surface of the fastener material shown does not include hook or loop material.

Figure 3:
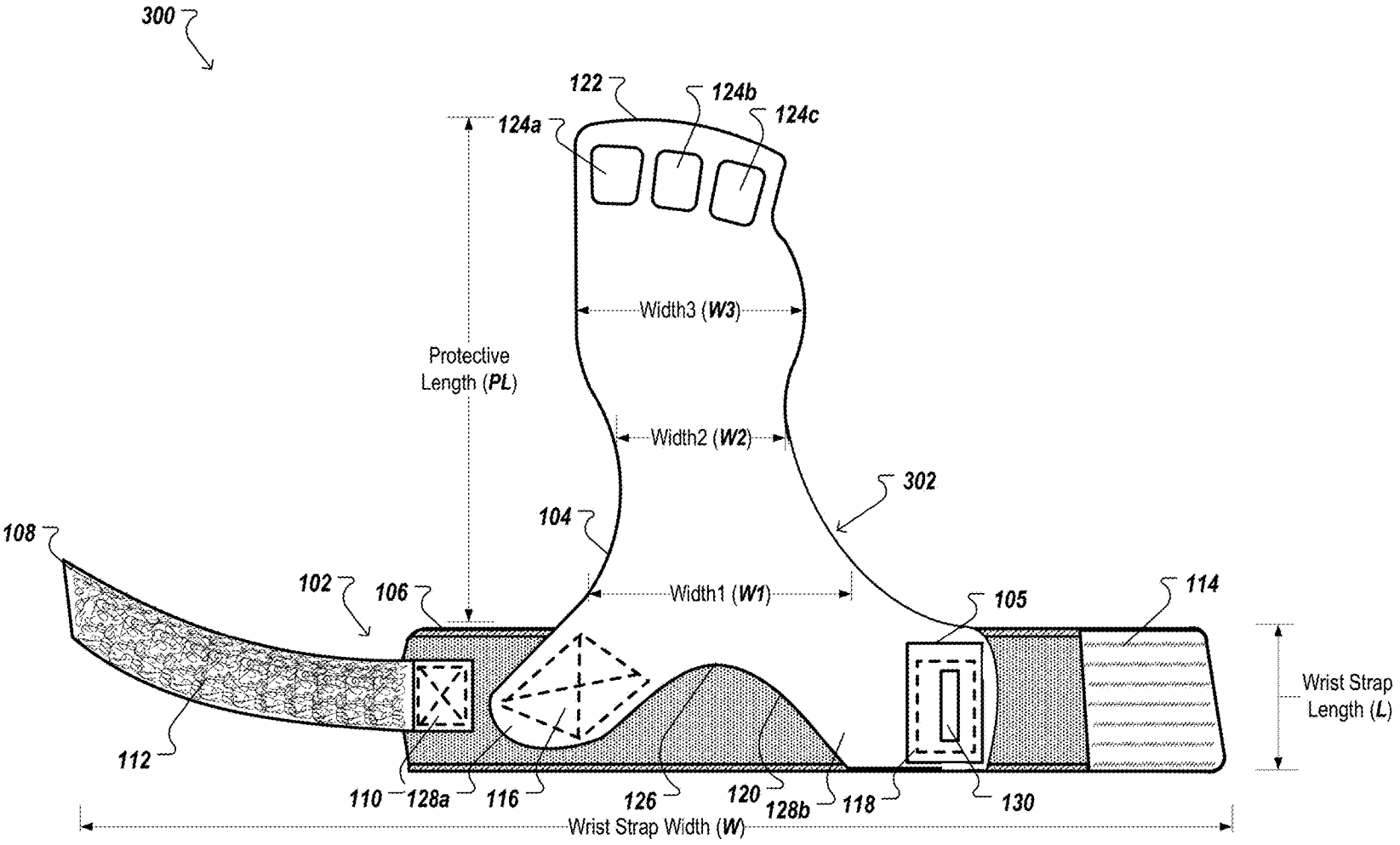
FIG. 3 is an illustration of another grip laid flat.

FIG. 3 is an example illustration of another grip 300. This grip 300 is substantially the same as the grip 100 discussed above, as shown by the use of the reference numbers 1xx, but the grip 300 has an edge 302 that differs slightly in shape relative to the corresponding edge of the grip 100. The exact shape of this edge 302 can vary depending on various factors, such as comfort, durability, and/or other reasons.

Figure 4:
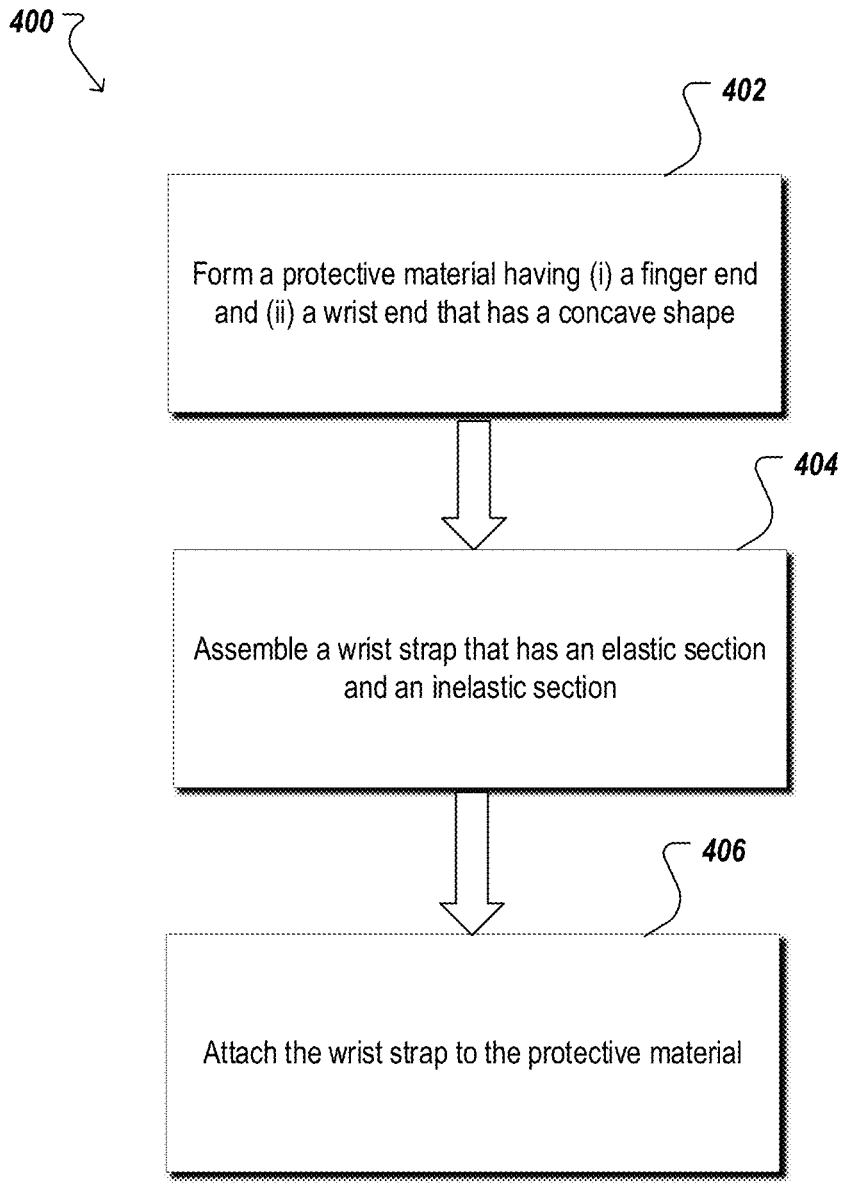
FIG. 4 is a flow chart of an example method for creating a grip.

FIG. 4 is a flow chart of an example process 400 for creating a grip. The process 300 can be used to manufacture or otherwise create the grips discussed throughout this specification.

A protective material is formed (402). The protective material is formed to have a wrist end, a finger end, and sides that extend from the finger end to the wrist end. The wrist end of the grip is formed to have a concave shape. More specifically, the concave shape of the edge of the wrist end is between the sides of the protective material that extend from the wrist end and the finger end. It is not necessary for the entire edge of the wrist end to form a concave shape. Rather, only a portion of the wrist end edge needs to have a concave shape, as shown in FIGS. 1A-3. The concave shape of the protective material at the wrist end defines at least two legs on opposite sides of the apex of the concave shape, as shown in FIGS. 1A-3. The concave shape can define, or be defined by, an arched void, a semicircle void, or an angled void at the wrist end of the protective material.

The formation of the protective material can include forming a wrist strap hole in one of the legs of the wrist end. The wrist strap hole can be defined in the opposite leg than the anchor location (discussed below), e.g., a leg that is on an opposite side of the apex of the convex shape than the anchor location.

In some implementations, the protective material can be formed to have different widths at different locations along an axis that extends between (and passes through) the wrist end and the finger end of the protective material. For example, the protective material can be formed so that the width of the protective material varies along a protective length (PL) of the protective material, as discussed in detail with reference to FIG. 1A.

The finger end of the protective material can have zero finger holes defined therein, thereby creating a "fingerless" grip. Alternatively, the finger end of the protective material can be formed to have two, three, or four finger holes. The finger holes are defined through a plane formed by the protective material when the protective material is laid flat. The finger holes can be defined by cutting, punching out, or otherwise penetrating the protective material to remove portions of the protective material at locations that are closer to the finger end than the wrist end.

A wrist strap is assembled (402). In some implementations, the wrist strap is assembled using multiple different materials. For example, the wrist strap can have an elastic section and an inelastic section. The elastic section can be formed using a portion of elastic material, and the inelastic section can be formed using a portion of inelastic material (e.g., a hook portion of hook and loop material). The inelastic section can be secured to a side of the elastic section that will be more proximate to an anchor location (discussed below) than the opposite side of the elastic section when the wrist strap is attached to the protective material. The elastic section and the inelastic section can be secured to each other, for example, by sewing the elastic section and the inelastic section together. Of course, other appropriate ways of securing the two sections together can be used. The location at which the elastic section and the inelastic section are joined/connected is referred to as a wrist strap junction.

The assembly of the wrist strap can include securing a fastener section to the elastic material. The fastener section can be, for example, a hook portion of a hook and loop material. The fastener section can be secured to the elastic section, for example, by sewing the fastener section to the elastic material. The fastener section can be secured to an end of the elastic section that is farthest away from the wrist strap junction. Of course, other appropriate ways of securing the two sections together can be used.

The wrist strap is attached to the protective material (406). The wrist strap can be attached, or otherwise secured, to the protective material at the anchor location. As discussed above, the anchor location is in one of the at least two legs of the wrist end of the protective material. For example, the anchor location can be in the leg that does not have the wrist strap hole defined therein. In other words, the anchor location can be in the leg that is on the opposite side of the apex of the concave shape of the wrist end relative to the leg in which the wrist strap hole is defined. In some implementations, the elastic section of the wrist strap is attached to the wrist end of the protective material at the anchor location.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A grip, comprising:

a protective material having a wrist end, a finger end, and sides that extend from the wrist end to the finger end; and a wrist strap attached to a first leg of the wrist end of the protective material, wherein:

the wrist end of the protective material has a concave shape that (i) is between the sides of the protective material and (ii) defines at least two legs on opposite sides of an apex of the concave shape;

the at least two legs includes the first leg and a second leg;

an angle between (i) a first axis that is tangential to the first leg and passes through the apex and (ii) a second axis that is tangential to the second leg and passes through the apex is less than 120 degrees.

2. The grip of claim 1, wherein the concave shape is defined by an arched void, a semicircle void, or an angled void at the wrist end of the protective material.

3. The grip of claim 2, wherein the wrist strap is secured to the protective material at an anchor location in the first leg among the at least two legs.

4. The grip of claim 3, wherein a wrist strap hole is located in the second leg that is on an opposite side of the apex of the concave shape than the anchor location.

5. The grip of claim 4, wherein the protective material has different widths at different locations along an axis that extends between the wrist end and the finger end.

6. The grip of claim 5, wherein:

the wrist strap comprises an elastic section and a non-elastic section;

the elastic section is attached to the wrist end of the protective material at the anchor location; and the non-elastic section is secured to a side of the elastic section that is more proximate to the anchor location than an opposite side of the elastic section;

the elastic section is configured to extend from the first leg to a second leg of the at least two legs; and the elastic section is configured to cover at least a portion of a void that is (i) defined by the concave shape and (ii) is located between the first leg and the second leg.

7. The grip of claim 6, wherein the protective material has three finger holes defined through a plane formed by the protective material laid flat.

8. The grip of claim 6, wherein the elastic section is connected to only the first leg, and the elastic section is configured to cover the apex of the concave shape when the wrist strap is wrapped around a hand.

9. The grip of claim 7, wherein an end of the elastic section of the wrist strap that is farthest away from the wrist strap junction anchor location includes a hook fastener material or a loop fastener material.

10. The grip of claim 1, wherein the protective material has zero finger holes defined therein.

11. A method, comprising:

forming a protective material having a wrist end, a finger end, and sides that extend from the wrist end to the finger end; and attaching a wrist strap to a first leg of the wrist end of the protective material, wherein:

the wrist end of the protective material has a concave shape that (i) is between the sides of the protective material and (ii) defines at least two legs on opposite sides of an apex of the concave shape;

the at least two legs includes the first leg and a second leg;

an angle between (i) a first axis that is tangential to the first leg and passes through the apex and (ii) a second axis that is tangential to the second leg and passes through the apex is less than 120 degrees.

12. The method of claim 11, wherein forming the protective material comprises forming the concave shape that defines an arched void, a semicircle void, or an angled void at the wrist end of the protective material.

13. The method of claim 12, wherein attaching the wrist strap to the protective material comprises securing the wrist strap to the protective material at an anchor location in the first leg among the at least two legs.

14. The method of claim 13, wherein forming the protective material comprises forming a wrist strap hole in the second leg that is on an opposite side of the apex of the concave shape than the anchor location.

15. The method of claim 14, wherein forming the protective material comprises forming the protective material to have different widths at different locations along an axis that extends between the wrist end and the finger end.

16. The method of claim 15, further comprising assembling the wrist strap, wherein:

the wrist strap comprises an elastic section and a non-elastic section that are attached at a wrist strap junction;

attaching the wrist strap to the wrist end of the protective material comprises attaching the elastic section to the wrist end of the protective material at the anchor location;

the elastic section is configured to extend from the first leg to a second leg of the at least two legs; and the elastic section is configured to cover at least a portion of a void that is (i) defined by the concave shape and (ii) is located between the first leg and the second leg.

17. The method of claim 16, wherein assembling the wrist strap comprises securing the non-elastic section to a side of the elastic section that is more proximate to the anchor location than an opposite side of the elastic section.

18. The method of claim 17, wherein forming the protective material comprises forming three finger holes defined through a plane formed by the protective material laid flat.

19. The method of claim 18, wherein an end of the elastic section of the wrist strap that is farthest away from the wrist strap junction includes a hook fastener material or a loop fastener material.

20. The method of claim 11, wherein the protective material has zero finger holes defined therein.

* * * * *